US005669099A

United States Patent [19]

Porcasi

[11] Patent Number: 5,669,099

[45] Date of Patent: Sep. 23, 1997

[54] SYSTEM FOR USE IN CLEARING CLOGGED DRAINS

[76] Inventor: Joe Porcasi, 123 W. Main Cross, Taylorville, Ill. 62568

[21] Appl. No.: 596,602

[22] Filed: Feb. 5, 1996

[51] Int. Cl.[6] ..... E03D 9/00

[52] U.S. Cl. ..... 15/341; 4/255.03; 15/406

[58] Field of Search ..... 15/341, 406; 4/255.02, 4/255.03

[56] References Cited

U.S. PATENT DOCUMENTS

| | | | |
|---|---|---|---|
| 1,769,061 | 7/1930 | Hhitchcock | 15/406 X |
| 2,052,563 | 9/1936 | Gould | 4/255.03 X |
| 2,056,018 | 9/1936 | Popp | 15/406 |
| 2,820,467 | 1/1958 | Mattich | 4/255.03 X |
| 5,239,708 | 8/1993 | Irwin | 4/255.03 |

*Primary Examiner*—Chris K. Moore

[57] ABSTRACT

The present invention relates to a system for using compressed air to dislodge a clog from a drain. The system includes a main housing defined by a handle component and a minor housing component. The handle component includes a rod and piston for use in delivering compressed air to the minor housing. The device further includes a spring-biased trigger for use in selectively delivering compressed air from the device into a clogged drain. Furthermore, the system of the present invention includes a plurality of drain closure members of various sizes adapted to fit into various sized drains. Thus, the user may select the appropriate sized drain closure depending on the specific application of the device.

4 Claims, 3 Drawing Sheets

22
20
24
36
34
38
2
2
42
46
46
3
3

SYSTEM FOR USE IN CLEARING CLOGGED DRAINS

BACKGROUND OF THE INVENTION

1. Field of the Invention

The present invention relates to a new and improved system for use in clearing clogged drains and, more particularly, pertains to a clog dislodging device employing a number of different sized drain closure members.

2. Description of the Prior Art

The use of devices for cleaning clogged drain lines is known in the prior art. More specifically, devices for cleaning clogged drain lines heretofore devised and utilized for the purpose of cleaning clogged drain lines with devices employing high pressure air are known to consist basically of familiar, expected, and obvious structural configurations, notwithstanding the myriad of designs encompassed by the crowded prior art which has been developed for the fulfillment of countless objectives and requirements.

The prior art discloses a large number of devices for clearing clogged drain lines. By way of example, U.S. Pat. No. 5,193,245 to Brzoska; U.S. Pat. No. 4,674,137 to Girse; U.S. Pat. No. 4,629,128 to Lawrence; and U.S. Pat. No. 4,736,473 to Gellatly all disclose devices for removing clogs from drain lines.

In this respect, the system for use in clearing clogged drains according to the present invention substantially departs from the conventional concepts and designs of the prior art, and in doing so provides an apparatus primarily developed for the purpose of providing a clog dislodging device employing a number of different sized drain closure members.

Therefore, it can be appreciated that there exists a continuing need for a new and improved system for use in clearing clogged drains which can be used for a clog dislodging device employing a number of different sized drain closure members. In this regard, the present invention substantially fulfills this need.

SUMMARY OF THE INVENTION

In view of the foregoing disadvantages inherent in the known types of devices for cleaning clogged drain lines now present in the prior art, the present invention provides an improved system for use in clearing clogged drains. As such, the general purpose of the present invention, which will be described subsequently in greater detail, is to provide a new and improved system for use in clearing clogged drains and methods which have all the advantages of the prior art and none of the disadvantages.

To attain this, the present invention essentially comprises a new and improved hand-held drain cleaning system employing pressurized air, the system comprising, in combination, a handle component having a first end, a second end, an exterior surface, an interior surface, an interior area, an aperture formed within the second end, a one-way valve positioned over the aperture for allowing air to flow from the interior area of the handle component, a piston positioned within the interior area of the handle, a rod coupled to the piston and extending through the first end of the handle component; a housing component having a first end, a second end, an interior area, and an exterior surface, the first end of the housing component being integral with the second end of the handle component, a cylindrical passage having a first end and a second end, the first end of the cylindrical passage in communication with the interior area of the housing, the second end of the housing being internally threaded, a stopper adapted to be positioned over the first end of the cylindrical passage, the stopper being pivotally secured to the interior area of the housing component; a trigger pivotally secured to the exterior surface of the housing, the trigger having a first orientation and a second orientation, the second orientation of the trigger effecting the pivotal movement of the stopper away from the first end of the cylindrical passage, a spring secured to the exterior surface of the handle component, the spring urging the trigger from its second to its first orientation; an extension member having a first end, a second end and an interior passage, the first end being externally threaded and adapted to engage the internal threads of the second end of the housing component such that the cylindrical passage comes into fluid communication with the interior passage of the extension member; and a plurality of drain closures, each of the drain closures having a first end of a uniform cross-section and a second end, the second end of each of the closures adapted to be positioned within the drain opening, each of the second ends having a different diameter.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for use in clearing clogged drains which has all the advantages of the prior art devices for cleaning clogged drain lines and none of the disadvantages.

It is another object of the present invention to provide a new and improved system for use in clearing clogged drains which may be easily and efficiently manufactured and marketed.

It is a further object of the present invention to provide a new and improved system for use in clearing clogged drains which is of a durable and reliable construction.

An even further object of the present invention is to provide a new and improved system for use in clearing clogged drains which is susceptible of a low cost of manufacture with regard to both materials and labor, and which accordingly is then susceptible of low prices of sale to the consuming public, thereby making such devices for cleaning clogged drain lines economically available to the buying public.

Still yet another object of the present invention is to provide a new and improved system for use in clearing clogged drains which provides in the apparatuses and methods of the prior art some of the advantages thereof, while simultaneously overcoming some of the disadvantages normally associated therewith.

Even still another object of the present invention is to provide a clog dislodging device employing a number of different sized drain closure members.

Lastly, it is an object of the present invention to provide a system for using compressed air to dislodge a clog from a drain. The system includes a main housing defined by a handle component and a minor housing component. The handle component includes a rod and piston for use in delivering compressed air to the minor housing. The device further includes a spring-biased trigger for use in selectively delivering compressed air from the device into a clogged drain. Furthermore, the system of the present invention includes a plurality of drain closure members of various sizes adapted to fit into various sized drains. Thus, the user may select the appropriate sized drain closure depending on the specific application of the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
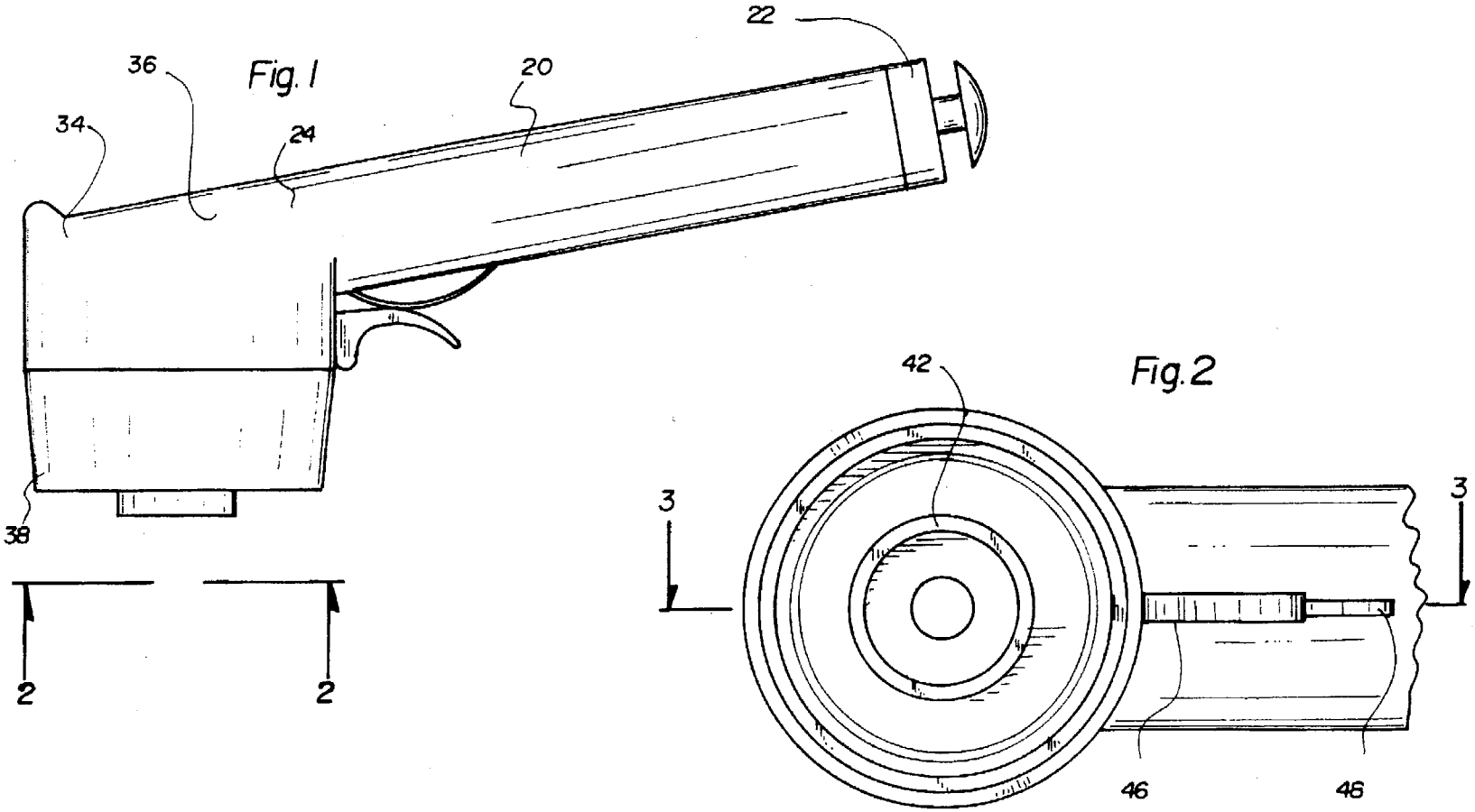
FIG. 1 is a side view of the device in accordance with the principles of the present invention.
FIG. 2 is a view taken along line 2—2 of FIG. 1.

With reference now to the drawings, and in particular to FIG. 1 thereof, the preferred embodiment of the new and improved system for use in clearing clogged drains embodying the principles and concepts of the present invention and generally designated by the reference numeral 10 will be described.

The present invention relates to a hand-held drain cleaning system employing pressurized air. In its broadest context, the system includes a major housing with a handle component and a housing component. The handle component includes a rod and piston disposed within its interior for the purposes of injecting air into the housing component. The housing component is adapted to be placed over a drain and have compressed air delivered therethrough to force out any clogs within the corresponding drain. The various components of the present invention, and the manner in which they interrelate, will be described in greater detail hereinafter.

The handle component 20 of the present invention is defined by a first end 22 and a second end 24. Furthermore, the handle component 20 is defined by an exterior surface, an interior surface and an interior area. The handle component 20 in general constitutes a means for delivering pressurized air into the forward portion of the device. To accomplish this, the handle component 20 includes an aperture formed within its second end 24. Over this aperture a one-way valve 26 is positioned. This one-way valve 26 allows air to flow from the interior area of the handle component 20 and does not allow air to flow into interior area of the handle component. Furthermore, a piston 28 is positioned within the interior area of the handle 20. A cylindrical rod 32 is coupled to one of the ends of this piston 28 for the purposes of driving the piston along the internal area of the handle component. The rod 32 extends through the first end 22 of the handle component 20. At the opposite end of the rod 32 is a user-engageable knob. Thus, the user may manipulate the piston 28 through the length of the internal area of the handle component 20 by way of the rod. Thus, upon a rearward stroke, air is drawn into the handle component 20 by way of an aperture provided within the handle component 20. Then, in the forward motion of the rod 32, air is forced through the one-way valve 26 and into the forward portion of the device. The function of this air and the route it travels to the drain will be described in greater detail hereinafter.

The device further includes a housing component 34 which is defined by a first end 36, a second end 38, an interior area and an exterior surface. The first end 36 of the housing component 34 is integral with the second end 24 of the handle component 20. A cylindrical passage 42 which is defined by a first end and a second end is in communication with the interior area of the housing component 34. The second end of the housing component 34 is internally threaded. The function of these internal threads will be described in greater detail hereinafter. A stopper 44 is adapted to be positioned over the first end of the cylindrical passage. This stopper is pivotally secured to the internal area of the housing component 34.

Figure 3:
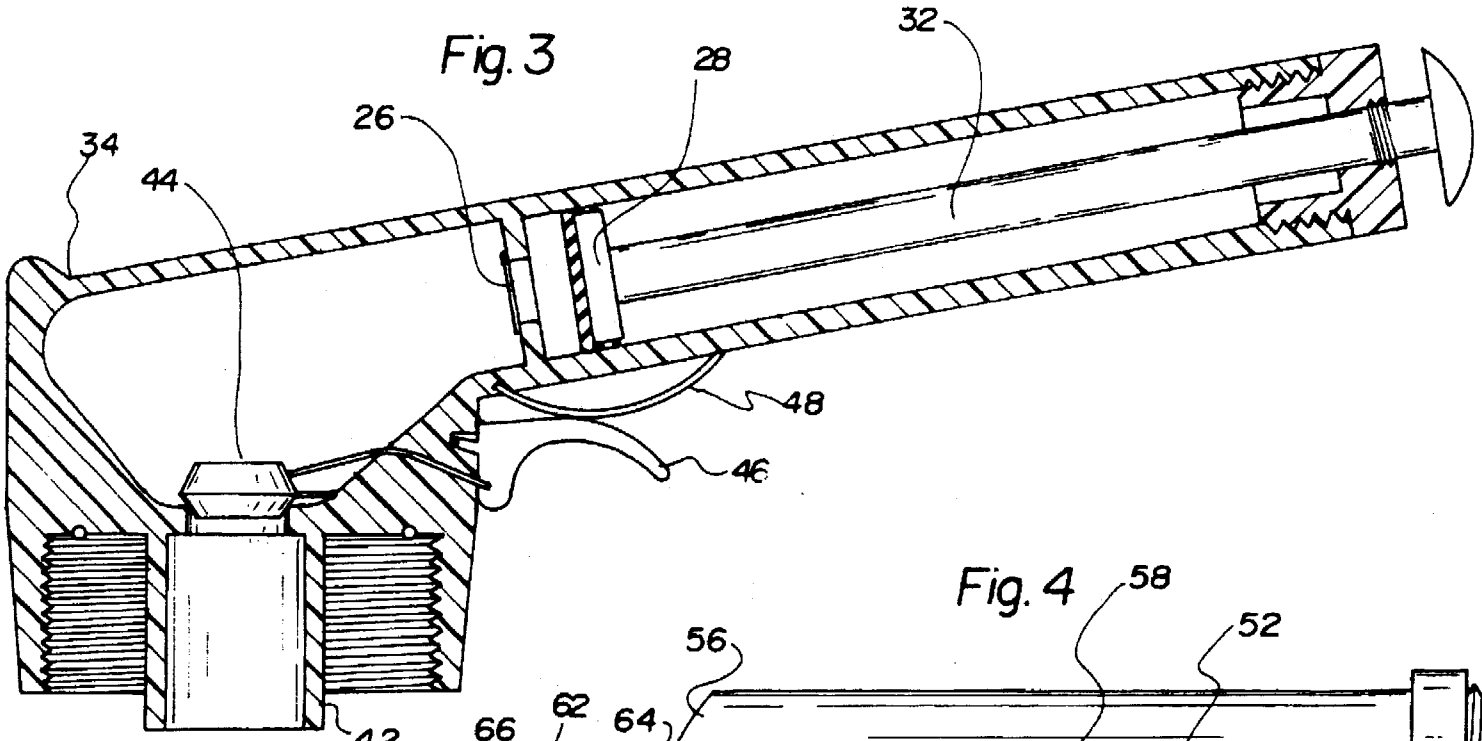
FIG. 3 is a sectional view of the device in accordance with the present invention.
Figure 4:
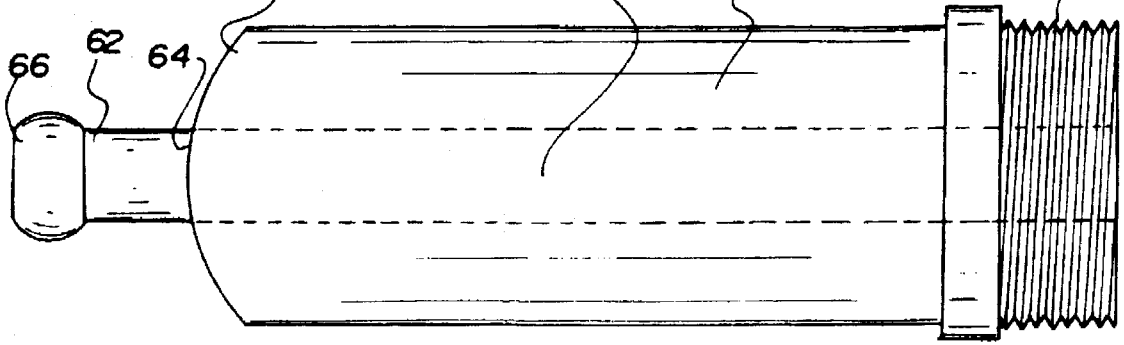
FIG. 4 is a view of the extension member in accordance with the present invention.

A trigger 46 which is pivotally secured to the exterior surface of the housing 34 functions to manipulate the stopper 44. More specifically, the trigger 46 has a first orientation and a second orientation with the second orientation of the trigger effecting the pivotal movement of the stopper 44 away from the first end of the cylindrical passage 42. A resilient spring 48 which is secured to the exterior surface of the handle component 20 functions to urge the trigger 46 from its second to its first orientation. In the preferred embodiment, the spring 48 takes the form of a resilient metallic band which is bowed outwardly from the surface of the handle component. This spring can most clearly be seen in FIGS. 1 and 3. The trigger 46 is operatively connected to the stopper 44 by way of a cable which passes through the side of the housing component 34. Thus, pivotal movement of the trigger 46 effects tensioning of the cable and the pivotal movement of the stopper 44.

In order to employ the device of the present invention with hard to reach drain areas, an extension member 52 is provided. This extension member is defined by a first end 54, a second end 56 and an interior passage 58 which extends between the first and second ends. The first end 54 is externally threaded and is specifically adapted to engage the internal threads of the second end 38 of the housing component 34. This threaded engagement insures that the cylindrical passage 42 comes into fluid communication with the internal passage 58 of the extension member 52. Thus, when it is needed, the extension member 52 can be screwed into the housing component 34 to extend the reach of the device.

Figure 5:
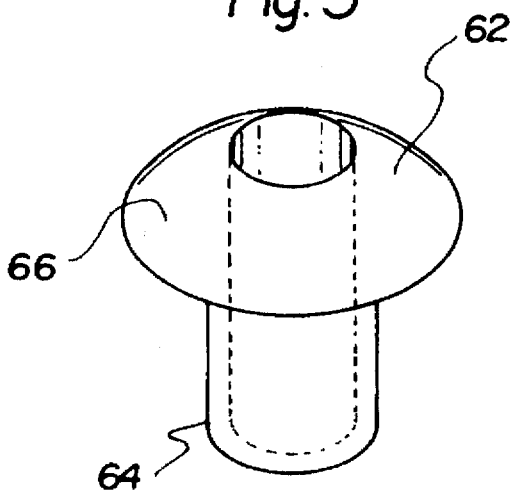
FIG. 5 is a view of one of the drain closure members in accordance with the present invention.
Figure 6:
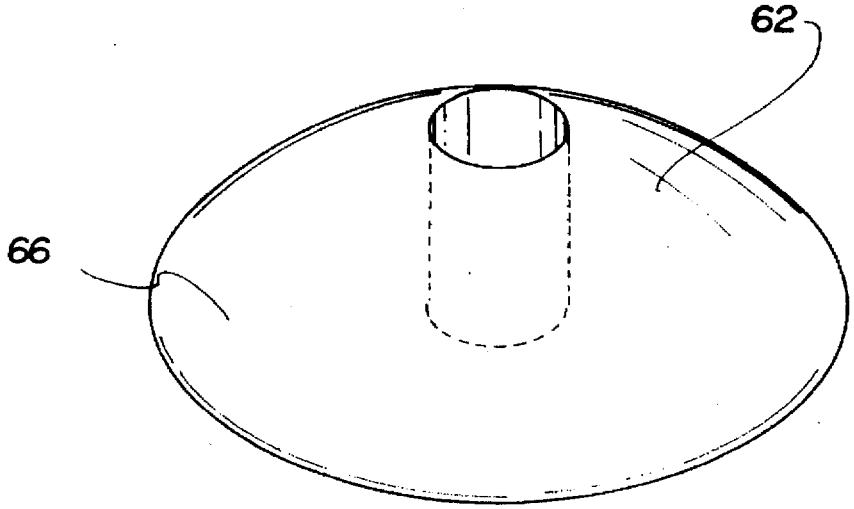
FIG. 6 is a view of another drain closure member in accordance with the present invention.

Furthermore, in an effort to make the present system more compatible with a wide variety of drains, a number of drain closures are included. Each specific drain closures 62 includes a first end 64 and a second end 66. Each of the first ends 64 are of a uniform diameter while the second ends are of an enlarged diameter. Furthermore, in the system, a plurality of such drain closures are provided with each of the second ends being of a different diameter. The second end of each of the closures is specifically adapted to be positioned within the drain opening while the first end is adapted to be secured to the second end 56 of the extension member 52. Alternatively, the first ends of the drain closures can be secured to the second end of the cylindrical passage 42. Two such drain closures are illustrated in FIGS. 5 and 6. As is evident from these illustrations, FIG. 5 is for use with a smaller drain opening while FIG. 6 is for use with a larger drain opening.

Thus in operation the user of the present invention while using the device in its first mode would fill the housing component with compressed air by way of the piston and rod assembly of the handle component. Namely, the operator would move the rod in a linear fashion back and forth to pressurize the interior area of the housing component. The one-way valve would prohibit any compressed air within the housing component from returning into the interior of the handle component. Furthermore, the stopper would prevent any air from escaping from the internal area of the housing component. When enough air was compressed within the internal area of the housing component, the second end of the cylindrical passage associated with the housing component would then be inserted over a drain opening to be unclogged. Next, the operator would maneuver the trigger to its second orientation thus pivoting the stopper away from the first end of the cylindrical passage and thus allowing the compressed air within the housing component to be delivered into the clogged drain. This compressed air would function in blowing any debris within the drain downstream and unclogging the drain.

In alternative uses, the device would be employed in the same manner however the extension member would be threaded into the second end of the housing component. Furthermore, depending on the drain size, an appropriate drain closure would be selected. Namely, a drain closure with the appropriately sized second end would be selected and inserted within the second end of the extension member or the second end of the housing component. In the preferred embodiment, the drain closures are made from an elastomeric material and would be press fit into the second end of the extension member or within the second end of the housing component, more specifically, the second end of the cylindrical passage. The materials for the construction of the handle component and the housing component can be an impact-resistant plastic or a lightweight metal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hand-held drain cleaning system employing pressurized air, the system comprising, in combination:

a handle component having a first end, a second end, an exterior surface, an interior surface, an interior area, an aperture formed within the second end, a one-way valve positioned over the aperture for allowing air to flow from the interior area of the handle component, a piston positioned within the interior area of the handle, a rod coupled to the piston and extending through the first end of the handle component;

a housing component having a first end, a second end, an interior area, and an exterior surface, the first end of the housing component being integral with the second end of the handle component, a cylindrical passage having a first end and a second end, the first end of the cylindrical passage in communication with the interior area of the housing, the second end of the housing being internally threaded, a stopper adapted to be positioned over the first end of the cylindrical passage, the stopper being pivotally secured to the interior area of the housing component;

a trigger pivotally secured to the exterior surface of the housing, the trigger having a first orientation and a second orientation, the second orientation of the trigger effecting the pivotal movement of the stopper away from the first end of the cylindrical passage, a spring secured to the exterior surface of the handle component, the spring urging the trigger from its second to its first orientation;

an extension member having a first end, a second end and an interior passage, the first end being externally threaded and adapted to engage the internal threads of the second end of the housing component such that the cylindrical passage comes into fluid communication with the interior passage of the extension member; and a plurality of drain closures, each of the drain closures having a first end of a uniform cross-section and a second end, the second end of each of the closures adapted to be positioned within the drain opening, each of the second ends having a different diameter.

2. A hand-held drain cleaning system employing pressurized air, the system comprising:

a handle component having a first end, a second end, an exterior surface, an interior surface, an interior area, an aperture formed within the second end, a one-way valve positioned over the aperture for allowing air to flow from the interior area of the handle component, a piston positioned within the interior area of the handle, a rod coupled to the piston and extending through the first end of the handle component;

a housing component having a first end, a second end, an interior area, and an exterior surface, the first end of the housing component being integral with the second end of the handle component, a cylindrical passage having a first end and a second end, the first end of the cylindrical passage in communication with the interior area of the housing, a stopper adapted to be positioned over the first end of the cylindrical passage, the stopper being pivotally secured to the interior area of the housing component; and a trigger pivotally secured to the exterior surface of the housing, the trigger having a first orientation and a second orientation, the second orientation of the trigger effecting the pivotal movement of the stopper away from the first end of the cylindrical passage, a spring secured to the exterior surface of the handle component, the spring urging the trigger from its second to its first orientation.

3. The system as described in claim 2 wherein:

the second end of the housing is internally threaded; and an extension member having a first end, a second end and an interior passage, the first end being externally threaded and adapted to engage the internal threads of the second end of the housing component such that the cylindrical passage comes into fluid communication with the interior passage of the extension member.

4. The device as described in claim 2 further comprising:

a drain closure having a first end of a first cross-section and a second end of an enlarged cross-section, the first end adapted to be interconnected with the second end of the housing component and the second end adapted for engagement with a drain.

* * * * *